US005915324A

United States Patent [19]

Gongwer

[11] Patent Number: 5,915,324

[45] Date of Patent: Jun. 29, 1999

[54] SCREEN SYSTEM FOR MARINE THRUSTERS

[76] Inventor: Calvin A. Gongwer, 19017 Leadora, Glendora, Calif. 91741

[21] Appl. No.: 09/020,478

[22] Filed: Feb. 9, 1998

[51] Int. Cl.[6] ..... B63H 25/46

[52] U.S. Cl. ..... 114/151; 440/67; 440/72

[58] Field of Search ..... 114/151; 440/66, 440/67, 72; 60/221, 222

[56] References Cited

U.S. PATENT DOCUMENTS 2,983,246 5/1961 Manley ..... 440/72
3,358,635 12/1967 McRee ..... 440/72
3,464,357 9/1969 Duport et al. ..... 114/151
5,470,262 11/1995 Bustillo ..... 440/67
5,540,605 7/1996 Lin ..... 440/46

*Primary Examiner*—Stephen Avila
*Attorney, Agent, or Firm*—Lyon & Lyon LLP

[57] ABSTRACT

A screen system for marine thrusters is devised having directionally streamlined screens with geometrically-shaped contoured gratings capable of imparting thrust-enhancing effects, thereby permitting high operational efficiency and the ability to operate with little or no reduction in thrust due to cavitation.

6 Claims, 3 Drawing Sheets

SCREEN SYSTEM FOR MARINE THRUSTERS

FIELD OF THE INVENTION

The field of the invention is thruster systems, including more particularly screens for marine thrusters.

DESCRIPTION OF RELATED ART

Marine vehicles, from large ships to umbilically controlled underwater robots (ROV's) and small submarines, typically use ducted propeller thrusters to control their position and altitude and, except for large ships and some submarines, to provide main propulsion. These thrusters can experience problems not limited to thrust-limiting cavitation at and near the surface, interruption of operations from ingestion of foreign objects, creating hazards to marine life and divers, and excessive screen resistance to flow.

What is needed is a system that addresses these problems while not reducing the thrust or efficiency of the thruster.

SUMMARY OF THE INVENTION

The present invention comprises directionally streamlined screens with geometrically-shaped contoured gratings capable of imparting thrust-enhancing effects, thereby permitting high operational efficiency and the ability to operate with little or no reduction in thrust due to cavitation.

The preferred embodiment of the invention includes a propeller that rotates in a duct between two preferably hexagonal rigid screens. The screens are streamlined for flow in one direction and unstreamlined for flow in the other direction and provide a hydrodynamic advantage to the thruster operation, tending to suppress loss of thrust from propeller cavitation and increase propeller efficiency in both directions, notwithstanding the screen's resistance to flow. Overall thruster performance enhancement results from the interaction of the effects imparted on the flow passing through a duct system enclosed by a bow screen, an aft screen and housing connecting the bow and aft screens. The housing contains a reversible propeller. The cumulative effects imparted on the flow by the propeller, bow screen, and aft screen accelerates flow velocity of downstream jets exiting the duct system while reducing the velocity inside the duct and around the motor.

The screens when made in larger dimensional scales can be applied to large ship transverse thrusters at each end of the tunnel with the same advantages. Also, in a preferred embodiment the screens act as structural support for the propeller shaft and/or drive motor.

DETAILED DESCRIPTION OF THE PREFERRED EMBODIMENT

Figure 1:
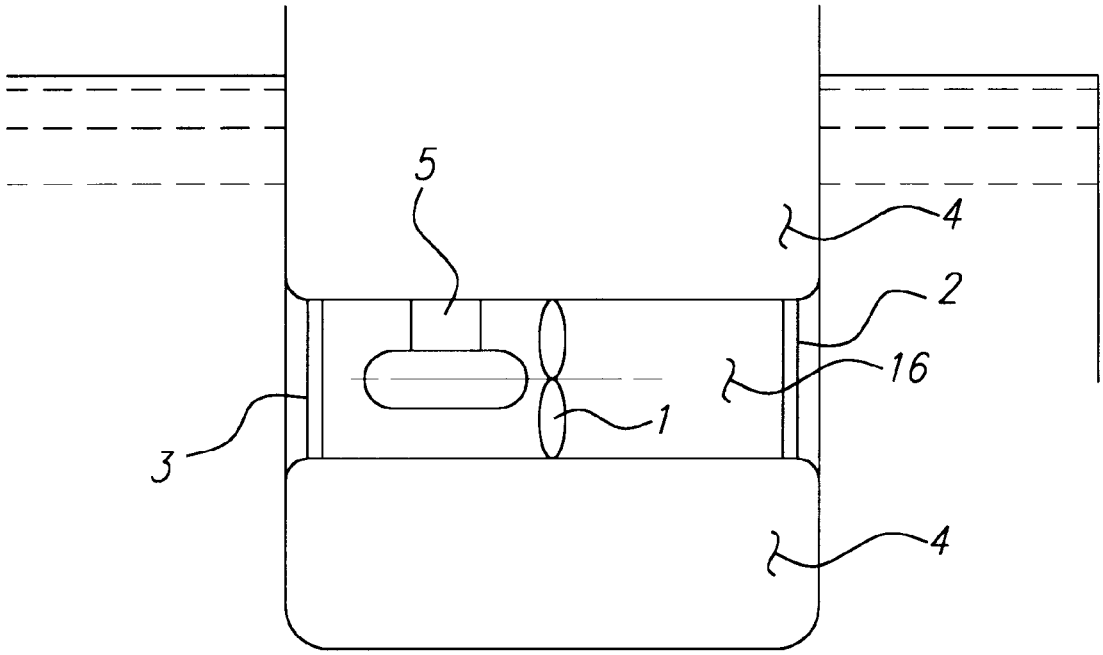
FIG. 1 is a cross-section of a thruster screen system in accordance with the present invention.

Referring to FIG. 1, a representative cross-section of a thruster-screen duct system of the present invention is shown. A thruster is mounted in a duct 16 enclosing a reversible propeller 1 with a pair of contoured streamlined screen elements: a bow screen 2 and an aft screen 3 in the housing, watercraft body or ship 4 the housing can have a contoured bottom sheet. In one operational configuration flow into the duct 16 enters via screen 2, passes by propeller 1 and exits the duct via aft screen 3. In reverse operation of propeller 1, flow enters the duct system via aft screen 3, passes by propeller 1 and exits the duct system via bow screen 2. Because propeller 1 is reversible, either operational configuration is possible. In a single directional system, either bow screen 2 or aft screen 3 may or may not be necessary.

Figure 3:
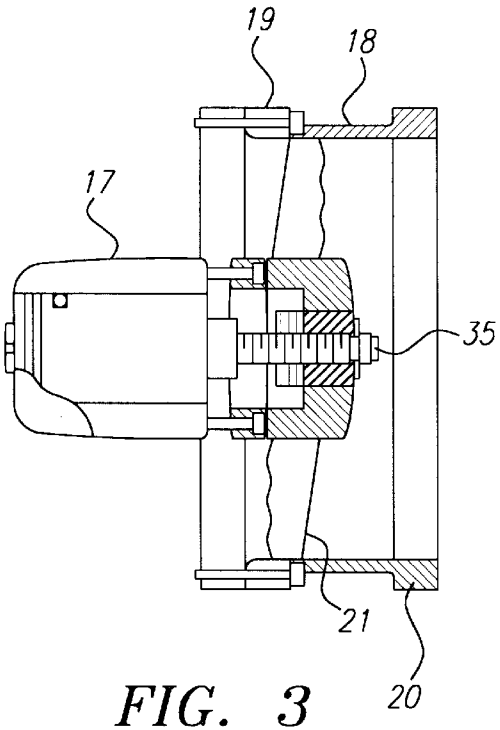
FIG. 3 is a side view of a motor and propeller attached to a propeller housing.

In FIG. 1, propeller 1 is shown mounted by means of mounting bracket 5. FIG. 3 shows a compact screened thruster system 20 of the present invention that can be mounted to the interior of a duct 16 without the need of the mounting bracket 5. Through the use of the unique rigid motor housing screen 33 and propeller screen 34 the motor housing may be mounted directly to interior of the duct by housing 18, as best shown in FIG. 3.

Figure 2:
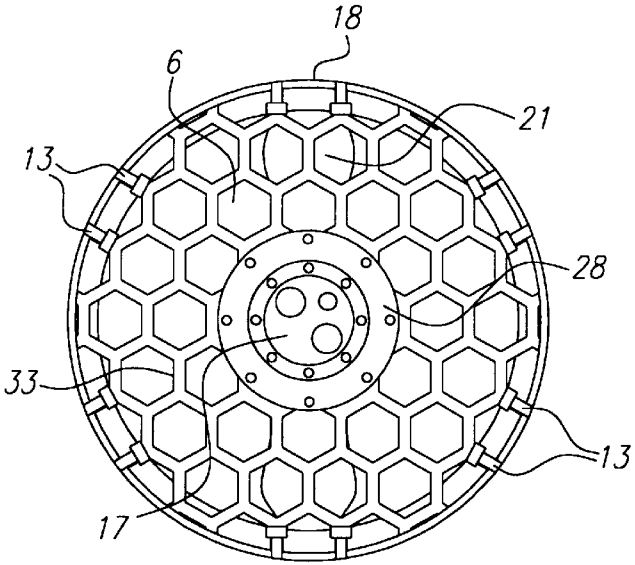
FIG. 2 is an end view of a thruster screen system.

FIG. 2 is an aft view of the screened thruster system. The housing motor screen 33 is attached to motor housing 17 by means of a motor mounting ring 28. This securely mounts the motor. The motor housing screen 33 is secured around its periphery to a housing 18 either by bolts or if desired permanently attached by welding mounting brackets in the form of clips or the like at 13. FIG. 2 shows the geometric shaped apertures 6 of motor housing screen 33 to be hexagonal. The motor housing screen 33 extends from the motor housing 17 to end of the housing 18 so that no debris can reach the propeller 21.

Figure 4:
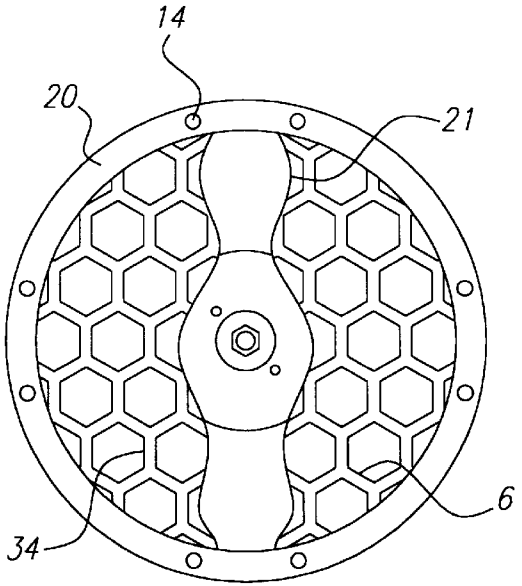
FIG. 4 is an opposite end view of a thruster screen system.

Hub 35 attaches the propeller 21 to the motor 17. The propeller 21 may be one of many typical reversible propeller configurations including preferable the orthoskew propeller described in U.S. Pat. No. 5,295,535 which is incorporated fully herein by reference. As seen in FIG. 4, which has a portion of the propeller screen 34 cut away, the unique shape of the blades of the orthoskew propeller provides efficient bi-directional thrust. The propeller screen 34 is attached to the housing 18 preferably bolts 14 spaced around the circumference of housing 18. While the housing 18 is shown cylindrical it could be any geometric shape that conforms to the interior cross sectional shape of the duct 16 in which it is to be mounted.

Figure 5:
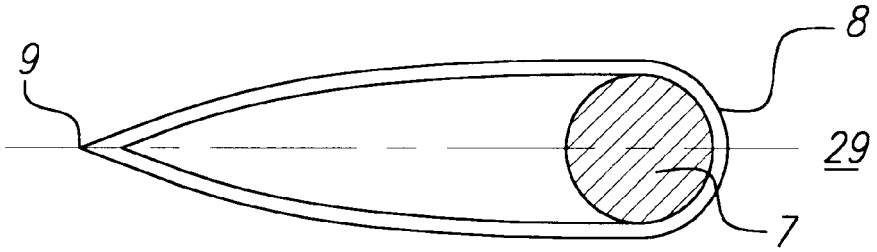
FIG. 5 is a cross-sectional view of a screen grating.

The screens 33 and 34 are preferably constructed in the same fashion with the apertures 6 forming the basic building block of the screen. In cross section, best shown in FIG. 5, the screen has a streamlined shape. The screen is preferably formed by wrapping sheet metal around a bar screen element 7 on one end and bringing the ends of the sheet metal together at the other to form the tapered end. The rounded side formed by the bar screen element forms a contoured end 8 and the end formed by the metal fairing without the screen bar is the tapered end 9. The tapered end 9 is arranged to be directed toward the propeller 1 and the contoured end 8 is to be directed away from propeller 1. The apertures 6 are preferably hexagonal shaped. This shape is preferable as the basic building block for the screen due to the large angle (120 degrees) between intersecting legs of the grating. This reduces the hydrodynamic interference between the geometric hexagons formed by apertures 6. A screen with square, triangular or other geometrically shaped openings may be preferable in some cases.

By examining the effects imparted on the flow by the various elements in the screen thruster system, the performance enhancements characterizing the present invention can be best described. This description will be done with reference to the compact screened thruster shown in FIGS. 2–4. It is to be understood that the same advantages will apply even if the screens are moved to the ends of a duct 16.

In either the reverse or forward rotation of propeller 1, flow enters the duct via a screen. Because the screens are each attached such that the tapered ends of the screens face outward in either direction the fluid flowing into the propeller is subjected to the same flow characteristics and the fluid exiting the propeller are also subjected to the same flow characteristics.

Figure 7:
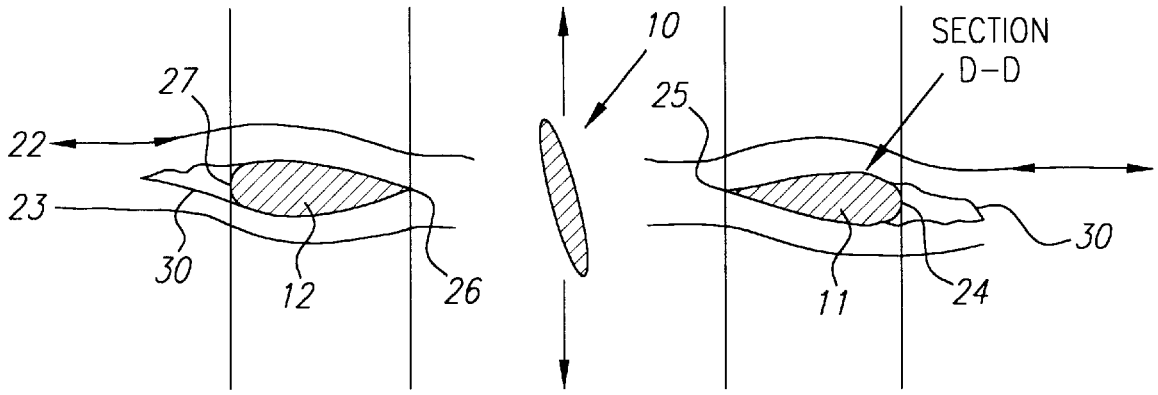
FIG. 7 is a cross-sectional view of the thruster screen system including representative flow lines.
Figure 6:
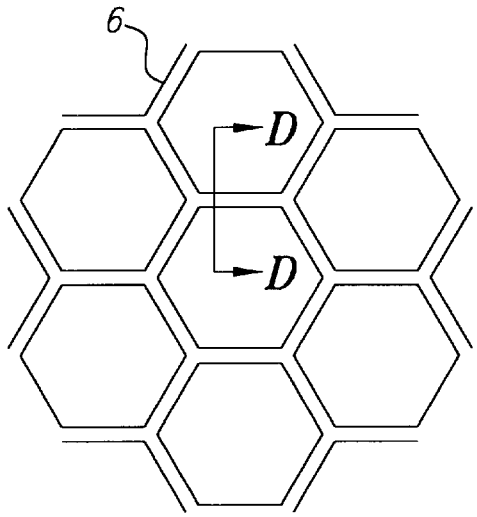
FIG. 6 is a portion of a hexagon-shaped screen grating.

FIG. 7 depicts a cross-sectional view of a preferred system, such as the one shown in FIG. 2. Since the thruster screen system can by bi-directional, flow can be directed from B-A-C or C-A-B in FIG. 7 along contour flow lines 22 and 23. In either case, it is shown that the tapered end 25 of screen 11 and the tapered end 26 of screen 12 are pointed to propeller 10. The contoured end 24 of screen 11 and the contoured end 27 of screen 12 coupled with the hexagonal-shaped gratings influence the effect from the tapered ends 25 and 26 to act as a nozzle, accelerating the flow to the higher velocity of the exit jets and reducing the velocity inside the duct and around the motor, propeller and so forth. Eddies 30 formed at the contoured ends 24 and 27 are also indicated in FIG. 7. The incoming flow to the propeller 10 is only slightly restricted since the screen parts are streamlined in this direction.

The flow exiting the propeller 10 has a large whirl corresponding to the torque on the propeller. A large portion of this energy of whirl is reclaimed in the exit screen from the thruster screen duct system due to the collimating effect of the screen downstream. The pressure drop across the screens 11 and 12 urges the flow in the axial direction. Due to the square exponent relation between flow velocity and head (meaning the transverse component of the velocity), if the transverse velocity component is reduced by only 50%, 75% of the whirl energy is recovered. This recovery effect helps compensate for the drag of the screens 11 and 12.

Figure 8:
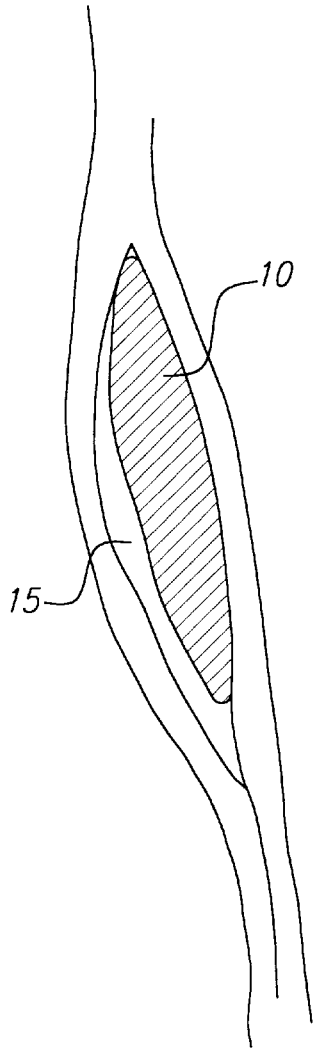
FIG. 8 is a side view of a propeller blade including representative flow lines.

The slightly reduced flow rate thru the propeller 10 causes the pressure on the suction side 15 of the propeller blades to increase and thus suppress the cavitation as explained below. The physical picture at breakdown cavitation is shown in the FIG. 8 where the static pressure on the suction side 15 of the propeller blade 10 is essentially zero. The suction side 15 of propeller blade 10 is created by a vapor cavity where the absolute pressure is the vapor pressure of water, virtually zero for cold water. This can be expressed by the Equation (1) which gives the static pressure on the suction side of the propeller blades:

$$\underset{\text{Atmospheric pressure}}{33\text{ ft}} + \underset{\text{depth in ft}}{d} - (V_p^2)/(2gS) = 0 \tag{1}$$

where $V_p$ is the axial velocity thru the propeller disc and S is the solidity the propeller (the projected blade area as a fraction of the swept disc area). Equation (1) is obtained by applying Bernoulli's theorem to the flow through the thruster inlet from the ambient sea. The slight drop in head thru the inlet screen need not be considered since the screen is streamlined in this direction. $V_p$ is related to the exit velocity out the exit screen by the following:

$$V_p=(V_eA_e)/(A_p) \tag{2}$$

from continuity, where $A_e$ and $A_p$ are the flow cross section areas at the exit and propeller disc respectively.

Substituting from (2) into (1):

$$33' + d' - \frac{(V_e^2A_e^2)}{2gS(A_p^2)} \tag{3}$$

Since the static thrust T is given by the expression:

$$T=\rho V_e^2A_e \tag{4}$$

where ρ is the mass density of sea water, (4) can be substituted into (3) to give the expression for maximum thrust at incipient cavitation breakdown (sometimes called "super cavitation").

Since from (4):

$$V_e^2=T/(\rho A_e) \tag{5}$$

then at the incipient cavitation breakdown condition:

$$T_c=(33+d)2Sg\rho(A_p^2/A_e^2) \tag{6}$$

Thus, Equation (6) shows that the thrust limit set by cavitation increases as $A_e$ decreases.

The resulting alleviation of the cavitation problem at or near the surface allows the propeller to be designed for maximum efficiency, i.e., higher blade lift coefficients resulting in smaller area and skin friction and higher ratios of pitch to diameter.

The screens can be applied to general purpose propulsion systems such as those found in tugboats where presently large propeller blades provide low efficiencies due to their large wetted areas subject to hydrodynamic skin drag. Large screens would be made preferably from cast stainless steel with round bar elements 7 and with the streamlined fairings 8, as in FIG. 5. The screens when made in large scale can also be applied to large ship transverse thrusters, again with the contoured ends 8 outward from the propeller, with similar advantages as those discussed herein.

What is claimed:

1. A directional thruster screen system comprising:

a bow screen having a periphery and having a grating that forms geometrically shaped inlets for flow said grating contoured with a rounded end and tapered end said rounded ended formed by a circular bar wrapped by a sheet that is tapered to form a tapered side, first clips attached to said periphery of said bow screen, an aft screen having a periphery and having a grating that forms geometrically shaped inlets for flow said grating contoured with a rounded end and tapered end said rounded ended formed by a circular bar wrapped by a sheet that is tapered to form a tapered side and said aft screen positioned parallel to said bow screen so that said tapered side of said grating of said aft screen points to said tapered side of said grating of said bow screen, second clips attached to said periphery of said aft screen, a thruster screen duct housing capable of attaching to said first clips and said second clips to enclose an interior duct channel having opposite ends, one end of said interior duct channel formed by said bow screen with said tapered side of said bow screen directed to the enclosed interior duct channel and one end of said duct channel formed by said aft screen with said tapered side of said aft screen directed to the enclosed interior duct channel, a thruster device having a propeller said thruster device attached to said thruster screen duct housing said propeller positioned in the enclosed interior duct channel.

2. A directional thruster screen system as in claim 1 wherein said propeller of said device is reversible.

3. A directional thruster screen system as in claim 1 wherein said first and second clips are mounting brackets capable of attaching said bow screen or said aft screen to the thruster screen duct housing.

4. A directional thruster screen system comprising:

a bow screen having a periphery and having a grating that forms geometrically shaped inlets for flow said grating contoured with a rounded end and tapered end said rounded ended formed by a circular bar wrapped by a sheet that is tapered to form a tapered side, bow screen brackets attached to said periphery of said bow screen and capable of attaching to a water craft, an aft screen having a periphery and having a grating that forms geometrically shaped inlets for flow said grating contoured with a rounded end and tapered end said rounded ended formed by a circular bar wrapped by a sheet that is tapered to form a tapered side and said aft screen positioned parallel to said bow screen so that said tapered side of said grating of said aft screen points to said tapered side of said grating of said bow screen, aft screen brackets attached to said periphery of said aft screen and capable of attaching to the underside of a water craft to enclose an interior duct channel having opposite ends and having a top and bottom, said bottom formed by a bottom sheet, one end of said interior duct channel formed by said bow screen with said tapered side of said bow screen directed to the enclosed interior duct channel and one end of said duct channel formed by said aft screen with said tapered side of said aft screen directed to the enclosed interior duct channel, said top of interior duct channel formed by said underside of said watercraft and said bottom of said interior duct channel formed by said bottom sheet attached to said bow screen brackets and said aft screen brackets, a thruster device mounting bracket connected to said underside of said watercraft, a thruster device having a propeller said thruster device attached to said thruster device mounting bracket said propeller positioned in the enclosed interior duct channel.

5. A directional thruster screen system as in claim 4 wherein said propeller of said device is reversible.

6. A directional thruster screen system as in claim 4 wherein said mounting bracket attaches to said bottom sheet.

* * * * *